United States Patent [19]

Akinbinu

[11] Patent Number: 4,647,044

[45] Date of Patent: Mar. 3, 1987

[54] SURFACE PROJECTILE GAME APPARATUS

[76] Inventor: Dayo M. Akinbinu, 1402 E. Guadalupe Rd., #151, Tempe, Ariz. 85283

[21] Appl. No.: 668,519

[22] Filed: Nov. 5, 1984

[51] Int. Cl.[4] ..... A63F 7/00; A63D 15/00

[52] U.S. Cl. ..... 273/125 R; 273/12

[58] Field of Search ..... 273/125 R, 123 R, 3 A, 273/14, 12

[56] References Cited

U.S. PATENT DOCUMENTS

| | | | |
|---|---|---|---|
| D. 83,276 | 2/1931 | Pavelka et al. | 273/3 A |
| 379,174 | 3/1888 | Martin | 273/125 R |
| 688,027 | 12/1901 | Moyer | 273/3 A |
| 1,856,117 | 5/1932 | Small | 273/125 R |
| 2,632,649 | 3/1953 | Schaefer | 273/125 R |

OTHER PUBLICATIONS

The Diagram Group, *The Way to Play,* p. 193.

*Primary Examiner*—Richard C. Pinkham
*Assistant Examiner*—Benjamin Layno
*Attorney, Agent, or Firm*—Richard R. Mybeck

[57] ABSTRACT

Game apparatus and methods of playing same are described. The apparatus comprises an enclosed rectangular playing surface having a plurality of target holes strategically disposed adjacent each end thereof; a plurality of target balls arranged one in proximity to each of the target holes; a plurality of U-shaped bumpers disposed one adjacent each of the target holes having its open end proximal to the transverse center line of the playing surface; a plurality of tunnels disposed to provide one, two or three tunnels astride the line of sight between a shooting point disposed outside of the half surface in which its corresponding target hole is placed and that target hole; a shooter ball; and a cue stick for propelling the shooter ball into collision with a preselected target ball.

15 Claims, 7 Drawing Figures

SURFACE PROJECTILE GAME APPARATUS

This invention relates generally to games, and more particularly to a game of skill in which a driven ball must pass through one or more tunnels to strike a target ball in an attempt to cause the target ball to score.

BACKGROUND OF INVENTION

Diverse types of games of trajectory skill exist in the form of marbles, billiards, and the like, in which a "shooter" is thrown or struck and it in turn strikes or urges toward a goal a targeted rolling or sliding object. Such existing trajectory skill games are generally played upon a bounded planar surface in which the targeted objects comprise the only trajectory obstacles. In the games of marbles, some variations allow the "shooters" to be risked or forfeited, while in other versions, the shooter is retrieved for iterated "shooting". In billiards and the like, a player who continues to succeed with each "shot" can delay or prevent an opponent from taking a turn until the successful player has amassed a winning score.

Despite the survival and continued popularity of existing games of trajectory skill, players seek novel and newly challenging games and it is to meet that end that the present invention was conceived and developed.

SUMMARY OF INVENTION

The present invention comprises a planar playing surface having a plurality of target holes strategically disposed adjacent the opposing ends of the surface separated by a transverse center line. Each target hole has a defined shooting trajectory or path past one of several points of center line intersection. Each shooting path is straddled by one or more wickets or tunnels. In play, the propelled shooter ball must pass through the tunnels correlated to the chosen target ball before it can strike the target ball and propel it into its corresponding target hole for a score. A player propels the shooter ball and controls its path by skillfully striking the shooter ball with a cuestick or the like. U-shaped bumpers are strategically disposed, one adjacent each target hole, to assist a slightly errant shooter-ball to locate its target ball and divert grossly errant shooter balls from the scoring area.

Accordingly, an object of the present invention is to provide a novel and unique game of skill and equipment upon which and with which to play it.

A further object of the present invention is to provide a novel game which challenges a player's senses of trajection and touch.

Another object of the present invention is to provide a new game combining the skill of billiards or pool, the interposition of multiple trajectory obstacles, and the acquisition of additional "shooter" objects according to scoring success during the course of the game.

Still another object of the present invention is to provide a game having a plurality of scoring paths of varying difficulty, all of which must be ultimately overcome for a player to prevail.

A further object of the present invention is to provide increased player interest and challenge, piqued by a plurality of alternative scoring strategies.

Yet another object of the present invention is to provide rapid, convenient retrieval and delivery of successfully scored balls to a location adjacent the scoring player.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

THE DRAWING

DESCRIPTION OF PREFERRED EMBODIMENT

Figure 1:
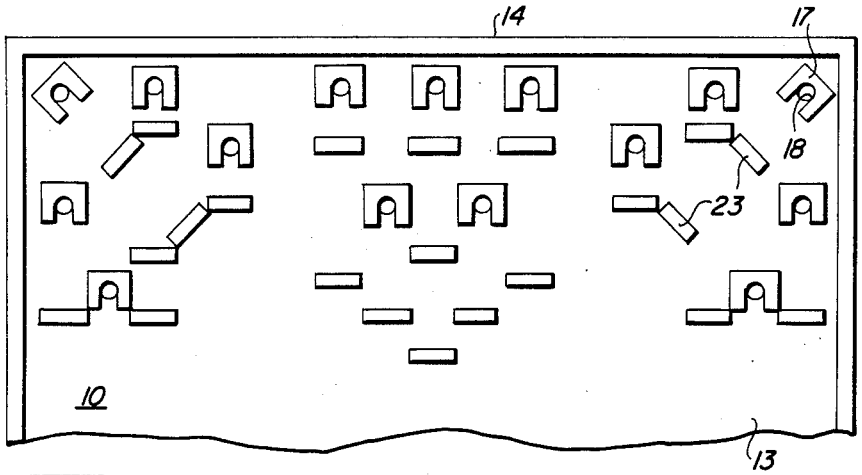
FIG. 1 is a top plan view of a portion of a playing surface of apparatus embodying the present invention.
Figure 2:
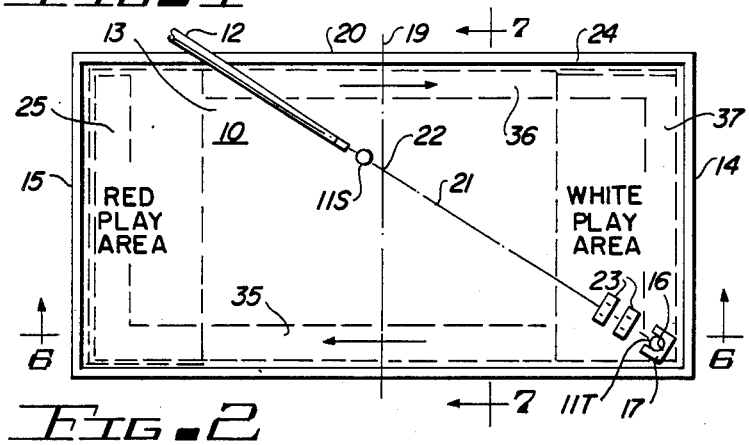
FIG. 2 is a full plan view of apparatus embodying the present invention.

Referring to FIGS. 1 and 2, a game apparatus embodying the present invention is shown at 10 and comprises a plurality of uniform size playing balls 11 defined, depending upon playing status, as shooter balls 11S and target balls 11T, motion imparting means 12, a planar playing surface 13 having first end 14 and second end 15, a plurality of first target holes 16 adjacent first end 14 in playing surface 13, a plurality of second target holes 18 adjacent second end 15 of playing surface 13, bumper strip 17 limiting lateral access to each of target holes 16, 18, a center line 19 orthogonally bisecting a longitudinal side 20 between ends 14 and 15, a plurality (not shown) of linear shooting paths exemplified by path 21; each path 21 extending respectively from a first target hole 16 adjacent end 14 across center line 19 at a point of intersection exemplified by point 22 upon playing surface 13, each linear shooting path 21 straddled by at least one tunnel 23, and an elevated bumper strip 24 circumscribing the periphery of playing surface 13. FIG. 2 further illustrates a first receptacle 25 disposed adjacent second end 15 and communicating through first collector tube means 35 with each of target holes 16 adjacent first end 14. In like manner, a second receptacle 37 disposed adjacent first end 14 communicates through second collector tube means 35 with each of target holes 18 adjacent second end 15. A typical shooting posture of a player utilizing motion imparting means 12 to strike a shooter ball 11S is shown in FIG. 2. Also shown in FIG. 2 is the spaced relationship of target hole 16, center line 19, bumper strip 17, tunnels 23, and one of linear shooting paths 21 upon playing surface 13 of game 10. While the invention contemplates other spaced relationships thereof, the relationships illustrated in FIG. 1 are particularly suitable for challenging players, with a variety of levels of difficulty in shooting along paths 21 straddled variously by one, two or three tunnels 23. Those skilled in the art will readily envision other spaced relationships, using numbers of target holes not necessarily equal to fifteen on a side, wherein non-interferring orthogonal and non-orthogonal paths may be defined.

Figure 3:
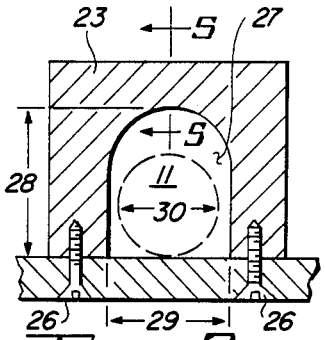
FIG. 3 is a frontal elevation of a tunnel embodying the present invention.

FIG. 3 is a side view of a tunnel 23 embodied in the present invention, typically comprised of wood, plastic and the like, secured to playing surface 13 by suitable securing means such as screws 26. Tunnel opening 27 has height 28 and width 29 respectively larger than the diameter 30 of typical playing ball 11.

Figure 4:
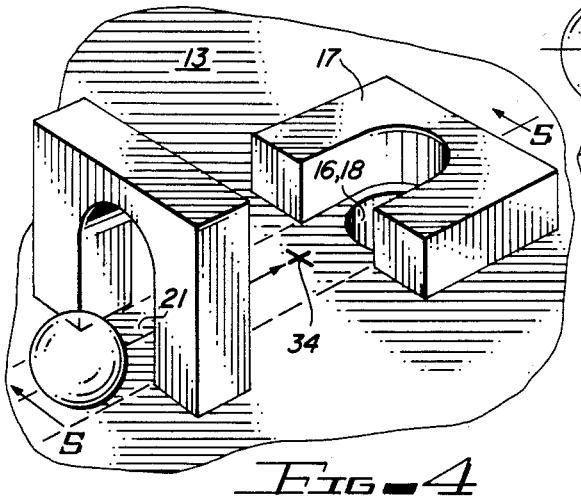
FIG. 4 is an isometric showing of a target hole, bumper and tunnel arranged in accordance with the present invention.
Figure 5:
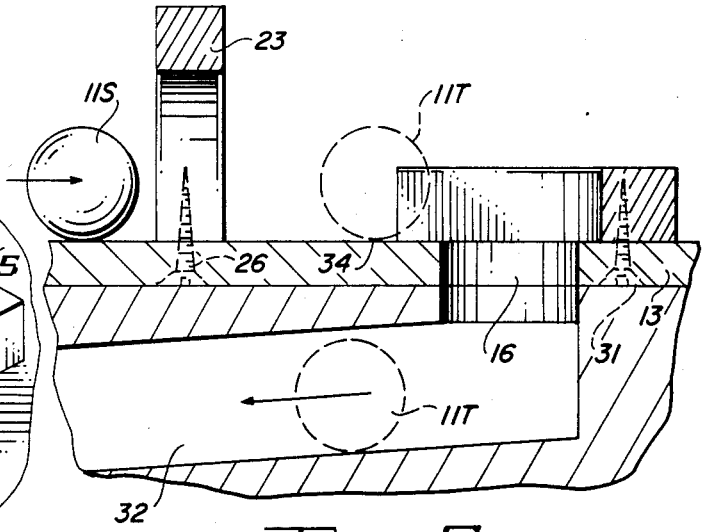
FIG. 5 is a cross-sectional view taken along line 5—5 of FIGS. 3 and 4.

In FIGS. 4 and 5, the association of a target hole 16 with its corresponding bumper 17 which limits the access of the playing ball 11 to hole 16 along linear shooting path 21. Screws 31 protrude upward through playing surface 13 to fasten bumper 17 thereto. A first end of a connector tube 35 descendingly communicates below playing surface to a receptacle 25 (see FIG. 2). During play of the game, a target ball 11T is quiescently emplaced upon playing surface 13 at a point 34 which lies on shooting path 21 in close proximity to target hole 16. A shooter ball 11S is propelled by the player to successfully strike target ball 11T and propel the target ball 11T into target hole 16. Ball 11T thereafter is drawn by gravity into and through connector tube 35 to receptacle 25 from which it can be readily retrieved for a later shot. If the trajectory of shooter ball 11S does not sufficiently adhere to shooting path 21, shooter ball 11S strikes and is deflected by one or more interposed tunnels 23, and thus fails to strike or impart sufficient momentum to target ball 11T to cause it to reach and descend into target hole 16. Greater precision of aim and shooting is required for a player to successfully traverse a plurality of tunnels 23 without bumping or deflection than is required to traverse a single tunnel 23.

Figure 7:
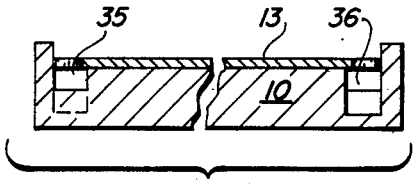
FIG. 7 is a lateral cross-sectional view taken along line 7—7 of FIG. 2.
Figure 6:
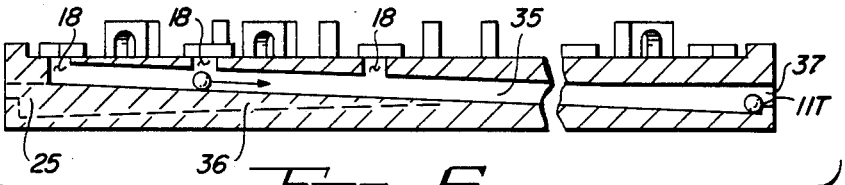
FIG. 6 is a cross-sectional view taken along line 6—6 of FIG. 2.

FIGS. 6 and 7 illustrate the descent of successfully scored target balls 11T from target holes 18 to receptacle 37 through sloping collector tube 36.

In one method of play utilizing the described apparatus, the rules are:

One player is assigned sixteen balls 11 of a first color, and the second player is assigned sixteen balls 11 of a second color. Fifteen of the first color balls 11 are quiescently emplaced in close proximity to each of the fifteen target holes 16 adjacent first end 14 along shooting paths 21. Fifteen of the second color balls 11 are similarly disposed in close proximity to each of the fifteen target holes 18 adjacent second end 15 along shooting paths 21. The one remaining ball 11 of each color is initially defined as a shooter ball 11S, and the initially emplaced balls 11 are defined as target balls 11T until such event that they are successfully driven into their respective target holes, whereupon each successfully driven target ball 11T becomes a shooter ball 11S for the player identified with said ball.

A choice is made by lot as to which player shall be first shooter and the other player becomes second shooter.

The shooter places his shooter ball 11S upon the playing surface 13 on the opposite side of center line 19 relative to the target ball at which he intends to shoot. Typically, the first shooter attempts said emplacement at his closest estimate to a line approximating the shooting path 21 corresponding to the target hole 16,18 which he has selected for an attempted score. The first shooter, by use of cuestick-like motion-imparting means 12 strikes shooter ball 11S, attempting to direct his blow with a precise direction and amount of force. Thus propelled, shooter ball 11S travels along shooting path 21, and successful in passing through corresponding straddling tunnels 23, collides with and drives the respective target ball 11T into its corresponding target hole 16,18.

If the first shooter's initial attempt to score is successful, he/she retrieves both the initial shooter ball 11S and the successfully driven target ball 11T, which now becomes defined a shooter ball 11S. Using his accumulated shooter balls 11S, the first shooter attempts in the same manner as above described to successfully drive another undriven target ball 11T to a scoring position. The player accumulates on each successful turn all of his previously employed shooter balls 11S plus all of the target balls 11T he has scored, retaining through each successive turn his right to use them again.

If, however, the first shooter exhausts his supply of shooter balls 11S without successfully driving a single target ball 11T into a scoring, his turn ends, and he must clear all of his shooter balls 11S, if any remain on the playing surface 13, to clear the surface for his opponent's turn.

The second shooter begins his first turn in the same manner as did the first shooter, aiming at balls 11T of the color assigned to him, and accumulating additional shooter balls 11S upon successful drives. The second shooter's turn ends in the same manner as did the first, that is, when he exhausts his supply of shooter balls 11S without successfully driving a target ball 11T into its corresponding hole. Turns alternate until one player has successfully converted all of his target balls 11T into shooter balls 11S.

In one embodiment of this game, denominated "Home Game", a winning condition is achieved by the first player to successfully drive his last remaining target ball into its corresponding target hole.

In another embodiment of this game, denominated "Double Edge", when the first-finishing player successfully drives his last undriven target ball into a scoring position, the opponent is given an opportunity to score his (the opponent's) remaining undriven target balls. If successful, the opponent has earned a tie game. However, if the opponent player fails to successfully score all of his remaining target balls, the first-finishing player is then permitted at attempt to score the opponent's remaining target balls, and if he is successful in scoring any one of them, he wins.

Still another embodiment of the game, denominated "Point Game", assigns one point to each target ball successfully sunk or scored by a shooter ball which passes under a single tunnel, two points if the shooter ball passes through two tunnels, and three points if achieved through three tunnels. Winning condition is achieved by the first player to amass fifteen points.

Yet another variation of the method of play, denominated "Alternate Home Game", is played in a fashion similar to the "Home Game", previously described, with the additional feature that approximately one-half the balls of each color are alternately intermixed at each end of the playing surface thereby causing the shooting player not only to aim at a target ball of his identified color but also to avoid inadvertently scoring his opponent's target ball. Driving an opponent's target ball into its target hole is credited to the opponent's score.

Other embodiments involve combinations and permutations of the above-described methods of scoring also add to player interest and challenge. Further, the number of holes and associated tunnels can be varied without departing from the spirit of the invention.

It is further understood that the apparatus and methods herein described and illustrated are quite suitable for but are not limited to a standard pool table size (4'×8'). Smaller tables which maintain the various geometric relationships between the shot line and the holes as herein described are equally suitable to provide the contemplated pleasure and challenge.

From the foregoing, it is apparent that a device has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

What is claimed is:

1. A game apparatus comprising: a plurality of uniform size playing balls wherein an equal number of said balls are identified by one of two contrasting colors said playing balls comprising movable playing balls and target balls; means for imparting motion to said movable playing balls; a planar playing surface having first and second ends and a center line orthogonally bisecting a longitudinal side between said first and second ends; a plurality of first target holes extending through said playing surface adjacent said first target end in spaced relationship to said center line and adapted to receive a playing ball for passage therethrough; a plurality of second target holes extending through said playing surface in spaced relationship to each other adjacent said second target end in spaced relationship to said center line and adapted to receive a playing ball for passage therethrough, each of said second target holes being disposed in corresponding symmetry to a corresponding one of said first target holes; a plurality of linear shooting paths, each interconnecting said center line and a different one of said target holes upon said playing surface, some of said linear shooting paths being single-tunnel paths, some being dual-tunnel paths, and the remainder being three-tunnel paths; one of said playing balls of one of said contrasting colors being positioned as a taget ball upon each one of said linear shooting paths in spaced adjacent relationship to the one of said target holes corresponding thereto at said first end and one of said playing balls of the other of said contrasting colors being positioned upon each one of said linear shooting paths in spaced adjacent relationship to one of said target holes corresponding thereto at said second end: said single-tunnel paths each having a tunnel secured to said playing surface in straddling disposition to each of said single-tunnel shooting paths, said dual-tunnel paths each having two tunnels secured to said playing surface in spaced parallel relationship to each other and in straddling disposition to each of said dual-tunnel shooting paths, and said three-tunnel paths each having three tunnels secured to said playing surface in spaced parallel relationship to each other and in straddling disposition to each of said three-tunnel shooting paths; each of said tunnels being positioned intermediate said target playing ball and said center line to permit the passage of one of said movable playing balls therethrough; and an elevated bumper strip circumscribing the periphery of said planar playing surface.

2. A game apparatus according to claim 1 wherein said plurality of first target holes communicate through a first descending collector tube disposed beneath said playing surface to a first receptacle disposed adjacent said second end, and said plurality of second target holes communicate through a second descending collector tube disposed beneath said playing surface to a second receptacle disposed adjacent said first end whereupon each ball passing through a target hole is delivered to the end of said playing surface opposite from said target hole through which said ball passed.

3. A game apparatus according to claim 1 wherein bumper means is emplaced upon said playing surface in spaced relationship to at least one said target hole for limiting directional access of said playing ball to said target hole.

4. A game apparatus according to claim 3 wherein said bumper means is U-shaped and the open end of the U-shaped bumper means provides the sole access of said playing ball to said target hole.

5. A game apparatus according to claim 1 wherein said playing surface is rectangular having a length at least twice its width.

6. A game apparatus according to claim 1 wherein said means for imparting motion to said playing balls comprises a cuestick.

7. A game apparatus according to claim 1 wherein at least one-half of said dual-tunnel paths define non-orthogonal angles of intersection with said center line.

8. A game apparatus comprising: a plurality of uniform size playing balls wherein an equal number of said balls are identified by contrasting colors, said playing balls comprising movable playing balls and target playing balls; means for imparting motion to said playing balls; a planar playing surface having first and second ends and a center line orthogonally bisecting a longitudinal side between said first and second ends; a plurality of first target holes extending through said playing surface adjacent said first target end and adapted to receive a playing ball for passage therethrough; a plurality of second target holes extending through said playing surface in spaced relationship to each other adjacent said second target end, each said second target hole being disposed in corresponding symmetry to said first target holes; a plurality of linear shooting paths interconnecting said center line and a corresponding target hole upon said playing surface each of said target holes adjacent each of said target ends having a distinct one of said shooting paths associated therewith, some of said linear shooting paths being single tunnel paths some being dual-tunnel paths, and the remainder being three-tunnel paths; said single-tunnel paths each having a single tunnel secured to said playing surface in straddling disposition to each of said single-tunnel shooting paths, said dual-tunnel paths each having two tunnels secured to said playing surface in spaced parallel relationship to each other and in straddling disposition to each of said dual-tunnel shooting paths, and said three-tunnel paths each having three tunnels secured to said playing surface in spaced parallel relationship to each other and in straddling disposition to each of said three-tunnel shooting paths; each of said tunnels being positioned intermediate said target playing ball and said center line to permit the passage of one of said playing balls therethrough; and an elevated bumper strip circums periphery of said planar playing surface.

9. A game apparatus according to claim 8 wherein said plurality of first target holes communicate through a first descending collector tube disposed beneath said playing surface to a first receptacle disposed adjacent said second end, and said plurality of second target holes communicate through a second descending collectoı tube disposed beneath said playing surface to a second receptacle disposed adjacent said first end whereupon each ball passing through a target hole is delivered to the end of said playing surface opposite from said target hole through which said ball passed.

10. A game apparatus according to claim 8 wherein bumper means is emplaced upon said playing surface in spaced relationship to at least one said target hole for limiting directional access of said playing ball to said target hole.

11. A game apparatus according to claim 10 wherein said bumper means is U-shaped and the open end of the U-shaped bumper means provides the sole access of said playing ball to said target hole.

12. A game apparatus according to claim 11 wherein said playing surface is rectangular having a length at least twice its width.

13. A game apparatus according to claim 12 wherein said means for imparting motion to said playing balls comprises a cuestick.

14. A game apparatus according to claim 12 wherein fifteen target holes are disposed adjacent said first end, and fifteen target holes are disposed adjacent said second end, each having a distinct one of said linear shooting paths associated therewith.

15. A game apparatus according to claim 8 wherein at least one-half of said dual-tunnel paths define non-orthogonal angles of intersection with said center line.

* * * * *